US007757754B2

(12) United States Patent
McKay

(10) Patent No.: US 7,757,754 B2
(45) Date of Patent: Jul. 20, 2010

(54) COMBINATION MOTOR CASING AND SPEAR

(75) Inventor: Graeme McKay, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/844,396

(22) Filed: Aug. 24, 2007

(65) Prior Publication Data

US 2009/0050310 A1 Feb. 26, 2009

(51) Int. Cl.
*E21B 29/00* (2006.01)

(52) U.S. Cl. ..... 166/55.7; 166/361

(58) Field of Classification Search ..... 166/57.7, 166/361, 298

See application file for complete search history.

(56) References Cited

U.S. PATENT DOCUMENTS 5,318,115 A 6/1994 Rouse
6,029,745 A * 2/2000 Broussard et al. ..... 166/298
6,056,049 A 5/2000 Davis
6,330,919 B1 * 12/2001 McGarian ..... 166/361
6,357,528 B1 3/2002 Davis et al.
6,598,678 B1 * 7/2003 Simpson et al. ..... 166/297
6,629,565 B2 * 10/2003 Harrell ..... 166/361
6,679,328 B2 1/2004 Davis et al.
6,877,570 B2 * 4/2005 Chen et al. ..... 175/22

* cited by examiner

*Primary Examiner*—William P Neuder
*Assistant Examiner*—Nicole A Coy
(74) *Attorney, Agent, or Firm*—Steve Rosenblatt

(57) ABSTRACT

A wellhead removal tool features a rotary cutter run by a Moyno type progressive cavity pump that is powered by fluid pumped through it. The stator of the motor has a gripping device with a series of collets or slip inserts that have grip features that face outwardly. A support shoulder on the grip assembly cooperates with a j-slot connection to the stator to allow a cone to be moved under the collets to push them into a grip position below or in a selected portion of the wellhead where the grip will not damage the wellhead internal components. Fluid pumped through the downhole motor causes the casing cutter blades to extend and rotate to cut the casing.

12 Claims, 2 Drawing Sheets

COMBINATION MOTOR CASING AND SPEAR

FIELD OF THE INVENTION

The field of the invention is tools that allow wellheads to be separated from conductor pipe and casing string tubulars and recovered from the sea bed to surface when the well is to be abandoned.

BACKGROUND OF THE INVENTION

When a well is to be abandoned, the wellhead is normally cut from the supporting tubular string and used on other wells. Since the wellhead is a very expensive item, great care has to be taken to avoid damaging it in the cutting and removal process. It is also desirable in some cases to make the casing cut as close to the wellhead as possible.

One example of how this was done in the past is illustrated in U.S. Pat. No. 5,318,115. The equipment illustrated there is a combination of a support and a motor driving a rotary tubing cutter with extendable blades. The support is an elaborate grapple design that features pivoting members that hook over the top of the wellhead and land in an external wellhead groove to brace the apparatus against reaction forces when the cutter is actuated. An alternative support of a threaded engagement into the top of the wellhead is suggested. The problem with this design is that it is complex and expensive and the wellhead has to be configured to accept the external grapple hook-shaped members that have to be pivoted into position. The wellhead is prepared with this feature which is used for the wellhead connector. The gripping members have to a have a depth of grip that matches the external groove locations on the wellhead. If the wellhead has no such grab locations, or if they are not in a specific location, the tool becomes useless in recovery of the wellhead. The threaded connection to a subsea wellhead entails risk of damage to the wellhead at the threads or further internally.

The present invention provides solutions to this problem that protect the wellhead and allow a common tool to be employed on a variety of wellhead designs that don't need to be specially made to accept the tool. The gripping assembly is simply actuated below the wellhead after passing through it and using a support shoulder to land near the bottom of the wellhead. As an alternative, the support shoulder can land on top of the wellhead to properly space out the grip assembly to land on an internal wellhead surface while minimizing damage from such grip or where a grip mark will not affect the operation of the wellhead. Those skilled in the art will further appreciate the various aspects of the invention from a review of the preferred embodiment and its associated drawings that appear below while recognizing that the claims define the full scope of the invention.

SUMMARY OF THE INVENTION

A wellhead removal tool features a rotary cutter run by a Moyno type progressive cavity pump that is powered by fluid pumped through it. The stator of the motor has a gripping device with a series of collets or slip inserts that have grip features that face outwardly. A support shoulder on the grip assembly cooperates with a j-slot connection to the stator to allow a cone to be moved under the collets to push them into a grip position below or in a selected portion of the wellhead where the grip will not damage the wellhead internal components. Fluid pumped through the downhole motor causes the casing cutter blades to extend and rotate to cut the casing. The grip allows the wellhead to be lifted away from the casing for recovery. The grip can be retracted by use of the j-slot to allow the tool to be removed from the wellhead.

DETAILED DESCRIPTION OF THE PREFERRED EMBODIMENT

Figure 1:
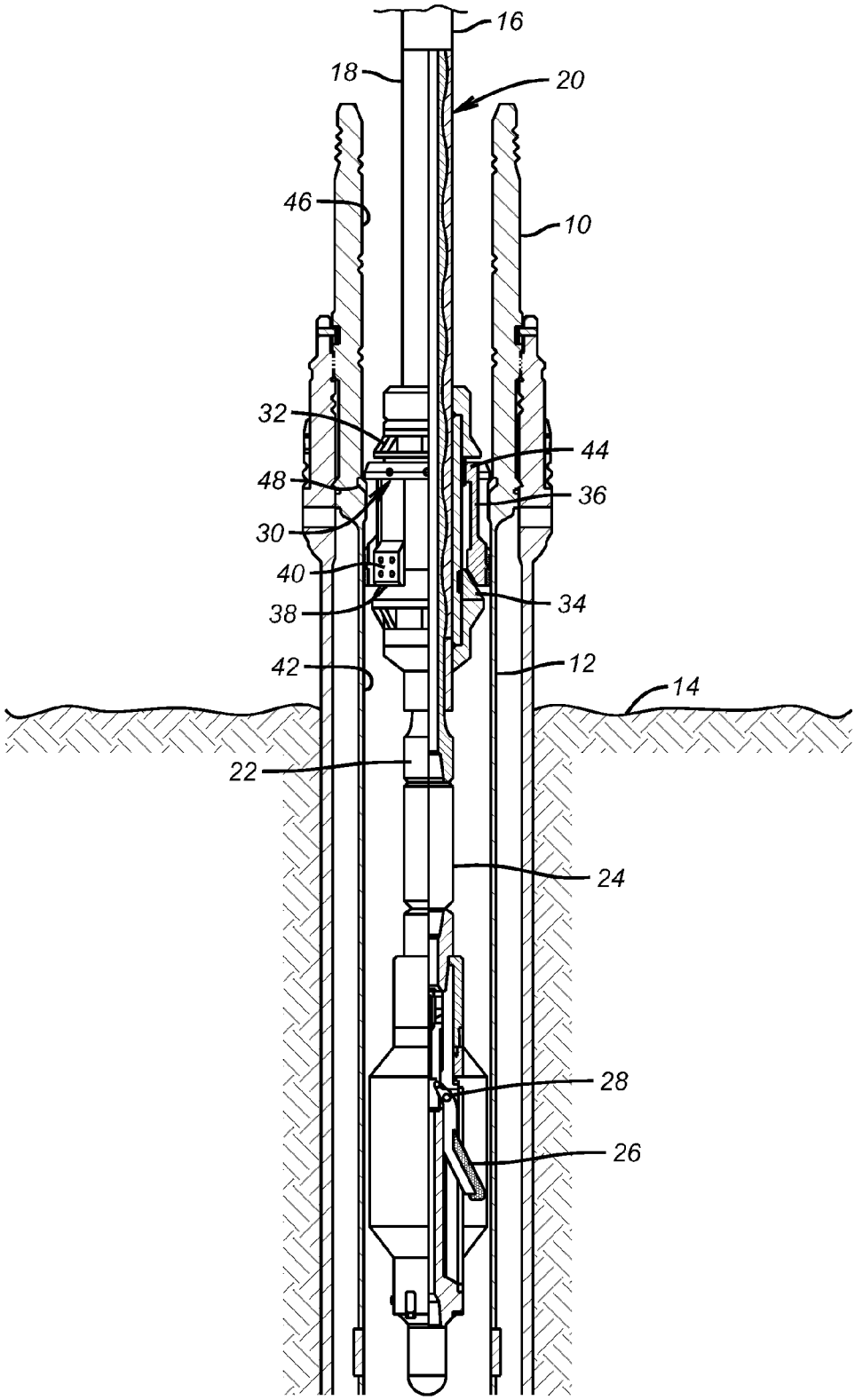
FIG. 1 is a section view with the tool supported in the wellhead and gripping the tubular below the wellhead.

FIG. 1 illustrates a wellhead 10 to be removed from casing 12. The wellhead 10 is under water and typically close to the seabed 14. A string 16 is run from the water surface, not shown, to a stator 18 of a downhole motor 20. The motor 20 is preferably a Moyno type progressive cavity device that is operated with pumped fluid through the stator 18 that caused the rotor 22 to turn in response to pumped fluid through the stator 18. The pumped fluid passes out of the stator housing 18 and around the rotor 22 and enters the crossover 24. From there the pressure of the fluid that passes through the crossover 24 causes blades 26 to pivot about pivot 28 until contact with the casing 12 is made. Rotor 22 rotation runs the extended blades along the casing 12 until a complete cut of casing 12 is accomplished. When that happens, the flow to motor 20 is cut off and the decrease in pressure allows the blades 26 to retract about pivot 28. Those skilled in the art will appreciate that while a single blade 26 is illustrated, that a plurality of blades is the preferred mode and only one is shown for drawing clarity.

Attached to the stator 18 is a gripping assembly 30 that comprises an upper hub 32 that is movably attached to the stator 18 with the preferred mode of attachment being a j-slot mechanism or a comparable device for allowing selective relative movement that is known in the art. The upper hub 32 moves in tandem with cone 34. These parts can move with respect to collet fingers 36 that terminate in heads 38 that optionally can have grip enhancing features such as hardened inserts or surface roughening 40 oriented toward the casing wall 42. The collet fingers 36 are joined at a ring 44 that is dimensionally sized to enter the bore 46 of the wellhead 10 and land on shoulder 48 near the lower end of the wellhead 10. The collet fingers 36 are sized long enough to place the grip enhancing features 40 outside the wellhead 10 bore 46 so that radial actuation by manipulation of the string 16 with the grip enhancing features 40 acting as drag blocks allows the desired relative motion that will bring the cone 34 under the collet heads 38 and wedge them radially into the casing wall 42. This is accomplished with a j-slot mechanism which allows the cone 34 to be brought under the fingers 36 to push them radially into a gripping contact with the tubular to be cut. As the tubular 12 is being cut, a pulling force greater than the weight of the wellhead 10 and the associated casing 12 to be cut is applied. When the cut is complete the applied force is reduced down to the weight of the assembly to be removed and this is a signal that the tubular 12 has been cut clean through. Thereafter, the string 16 is raised up to remove the wellhead 10 and the casing 12 above the cut. If necessary, the grip of the fingers 36 with their grip enhancing feature 40 can be released by setting down weight and rotation so that on subsequent picking up of the string 16 the cone 34 will be prevented from engaging the fingers 36 and the assembly can be pulled from the wellhead 10.

Figure 2:
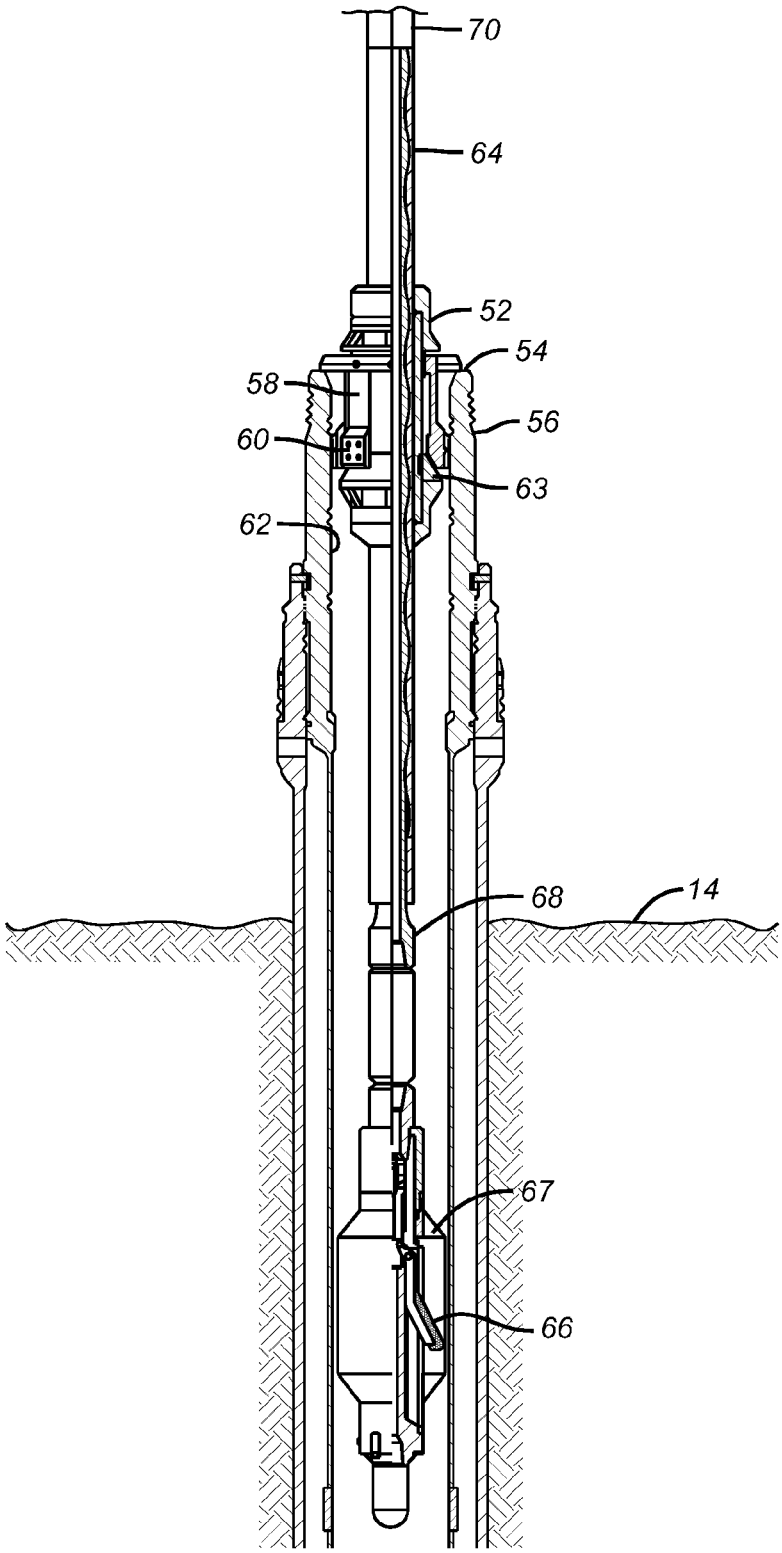
FIG. 2 is an alternative embodiment supporting the tool on the wellhead and getting a grip in a portion of the wellhead where the grip will not damage the functioning of the wellhead.

FIG. 2 illustrates an alternative design where the upper hub 52 lands on the top 54 of wellhead 56. Fingers 58 are sized to grip with grip feature 60 the inside 62 of the wellhead 56 when pushed out by the cone 63 in the manner of operation described for FIG. 1. As in FIG. 1 the relative position of the stator 64 with respect to hub 52 of the gripping assembly can be adjusted to allow shortening the distance from the support point, such as top 54 of wellhead 56 and the cut location made by cutters 66 that pivotally extend from casing cutter 67 when the rotor 68 to which it is attached is rotated by fluid pumped from string 70 through stator 64.

Those skilled in the art will appreciate that the present invention provides optional suspension locations on top of the wellhead and within the wellhead. When supported as shown in FIG. 2, the grip feature 60 does grip inside the wellhead at 62 and that may require the wellhead to be redressed before reuse. However, an advantage of having the cut made by blades 66 as close as desired or allowed by regulation below the sea bed 14 is an option because the placement of hub 52 on the stator 64 can be varied. The nature of the gripping assembly can also be changed within the scope of the invention.

As shown in FIG. 1 the hub 32 is made small enough to go into bore 46 to land on shoulder 48. In this embodiment, the grip face 40 contacts the tubular 12 below the wellhead so that there is no need to redress the wellhead before it is reused. Once again the distance from the support location to the cut location can be varied by adjusting the relative position on hub 32 on the stator 18. This distance can be made as short as 2.5 meters or less depending on the equipment size. Being able to control the depth of the cut location allows the job to be done quicker in some applications as the procedure can be shortened to cut the larger casings in a single operation.

The short depth of the cut is accomplished by directly connecting the casing cutter to the rotor and eliminating centralizers used in the prior art. In the preferred embodiment the crossover 24 is connected to the rotor and the casing cutter is directly below. Due to the close proximity between the bottom of the stator and the rotating blades such as 26 or 66 the centralizers used in the past can be eliminated and the cut depth below the support location can be significantly reduced.

The above description is illustrative of the preferred embodiment and various alternatives and is not intended to embody the broadest scope of the invention, which is determined from the claims appended below, and properly given their full scope literally and equivalently.

I claim:

1. A wellhead removal apparatus from a downhole tubular, comprising:

a tubular cutter;

a motor further comprising a rotor and a surrounding housing with said rotor supporting said cutter for selective cutting of the tubular without a centralizer on said rotor or said housing in the tubular to be cut by said cutter;

a selectively extendable grip attached to said motor housing for support of said motor within the wellhead or the downhole tubular adjacent said wellhead;

said cutter remaining at a fixed distance from said extended grip;

said cutter cutting the tubular at a distance where said cutter locates when said grip obtains support, said distance determined by the length said housing, rotor and cutter extend from said support of said grip.

2. The apparatus of claim 1, wherein:

said grip supports said motor below the wellhead; and said cutter comprises a casing or conductor cutter.

3. The apparatus of claim 1, wherein:

said grip supports the motor within the wellhead.

4. The apparatus of claim 1, wherein:

the mounting location of said grip is adjustable along the motor.

5. The apparatus of claim 4, wherein:

said motor is a progressing cavity type motor and said grip is attached to a stator on said motor and said cutter is mounted to a rotor of said motor.

6. The apparatus of claim 5, wherein:

said grip further comprises a landing hub to engage the wellhead to locate said grip within or below the wellhead.

7. The apparatus of claim 1, wherein:

said grip further comprises a landing hub to engage the wellhead to locate said grip within or below the wellhead.

8. A wellhead removal apparatus from a downhole tubular, comprising:

a tubular cutter;

a motor supporting said cutter for selective cutting of the tubular;

a selectively extendable grip for support of said motor within the wellhead or the downhole tubular;

said grip further comprises a landing hub to engage the wellhead to locate said grip within or below the wellhead;

said grip comprises a plurality of fingers with grip heads and said motor comprises a cone selectively engageable with said heads to drive them radially outwardly for a grip.

9. The apparatus of claim 8, wherein:

said cone is mounted to a stator portion of said motor;

said stator is mounted for selective relative movement with respect to said landing hub when said landing hub is supported on the wellhead to selective advance and retract said cone with respect to said heads.

10. A wellhead removal apparatus from a downhole tubular, comprising:

a tubular cutter;

a motor supporting said cutter for selective cutting of the tubular;

a selectively extendable grip for support of said motor within the wellhead or the downhole tubular;

a mounting location of said grip is adjustable along the motor;

said motor is a progressing cavity type motor and said grip is attached to a stator on said motor and said cutter is mounted to a rotor of said motor;

only a crossover is connected between said cutter and said rotor.

11. A wellhead removal apparatus from a downhole tubular, comprising:

a tubular cutter;

a motor supporting said cutter for selective cutting of the tubular;

a selectively extendable grip for support of said motor within the wellhead or the downhole tubular;

a mounting location of said grip is adjustable along the motor;

said motor is a progressing cavity type motor and said grip is attached to a stator on said motor and said cutter is mounted to a rotor of said motor;

said grip further comprises a landing hub to engage the wellhead to locate said grip within or below the wellhead;

said grip comprises a plurality of fingers with grip heads and said motor comprises a cone selectively engageable with said heads to drive them radially outwardly for a grip.

12. The apparatus of claim 11, wherein:

said cone is mounted to a stator portion of said motor;

said stator is mounted for selective relative movement with respect to said landing hub when said landing hub is supported on the wellhead to selective advance and retract said cone with respect to said heads.

* * * * *